US009760044B2

(12) United States Patent
Song et al.

(10) Patent No.: US 9,760,044 B2
(45) Date of Patent: Sep. 12, 2017

(54) PHASE CONTROL METHOD OF AC POWER SUPPLIED TO A FUSER AND AN IMAGE FORMING APPARATUS HAVING THE SAME

(71) Applicant: S-PRINTING SOLUTION CO., LTD., Suwon-si, Gyeonggi-do (KR)

(72) Inventors: Young-jun Song, Seoul (KR); Sung-hoon Lim, Hwaseong-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 14/705,300

(22) Filed: May 6, 2015

(65) Prior Publication Data

US 2016/0062284 A1 Mar. 3, 2016

(30) Foreign Application Priority Data

Sep. 3, 2014 (KR) ..... 10-2014-0117031

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/2078
USPC ..... 399/69
See application file for complete search history.

(56) References Cited

U.S. PATENT DOCUMENTS 5,955,794 A * 9/1999 Schulz ..... H02P 25/14 307/127
2003/0072581 A1 4/2003 Nishida
2003/0219270 A1 11/2003 Kondo
2004/0022550 A1* 2/2004 Okada ..... G03G 15/5004 399/67
2004/0090805 A1* 5/2004 Kitano ..... H02H 7/1227 363/55
2010/0310267 A1* 12/2010 Shimura ..... G03G 15/2039 399/69
2010/0316404 A1* 12/2010 Fukuzawa ..... G03G 15/2039 399/69
2011/0064444 A1* 3/2011 Adachi ..... G03G 15/80 399/69
2011/0217062 A1* 9/2011 Chosokabe ..... G03G 15/80 399/69

(Continued)

FOREIGN PATENT DOCUMENTS

JP 2006323554 A * 11/2006
JP 2010104170 A * 5/2010

(Continued)

*Primary Examiner* — G. M. Hyder
(74) *Attorney, Agent, or Firm* — Staas & Halsey LLP

(57) ABSTRACT

An image forming apparatus includes a phase controller for controlling input power applied to a heating body through phase control. The image forming apparatus includes a fuser having the heating body, a switching unit supplying the input power to the heating body, and a phase controller determining an input phase of the input power based on a temperature of the fuser, in which the phase controller further controls the switching unit to vary a phase of the input power supplied to the heating body within a phase range set based on the input phase, for each control cycle of the input power.

18 Claims, 8 Drawing Sheets

(56) References Cited

U.S. PATENT DOCUMENTS

| | | | | |
|---|---|---|---|---|
| 2011/0299868 | A1* | 12/2011 | Ito | G03G 15/2039 399/69 |
| 2011/0311260 | A1* | 12/2011 | Nakajima | H02M 3/3385 399/88 |
| 2013/0071134 | A1* | 3/2013 | Hikari | G03G 15/80 399/88 |
| 2013/0272738 | A1* | 10/2013 | Kawakami | G03G 15/205 399/69 |

FOREIGN PATENT DOCUMENTS

| | | | |
|---|---|---|---|
| JP | 2012-094055 | | 5/2012 |
| JP | 2012-206874 | | 10/2012 |
| JP | 2014155232 | A * | 8/2014 |

* cited by examiner

PHASE CONTROL METHOD OF AC POWER SUPPLIED TO A FUSER AND AN IMAGE FORMING APPARATUS HAVING THE SAME

RELATED APPLICATIONS

This application claims the benefit under 35 U.S.C. §119 of Korean Patent Application No. 10-2014-0117031, filed on Sep. 3, 2014, in the Korean Intellectual Property Office, the disclosure of which is incorporated herein in its entirety by reference.

BACKGROUND

1. Field

One or more example embodiments relate to an image forming apparatus and a phase control method.

2. Description of the Related Art

Image forming apparatuses include a fuser for fusing an image on a print paper by applying heat to the print paper. The temperature of the fuser has an influence on print quality. Accordingly, the temperature of the fuser should be accurately controlled.

In order to control the temperature of a fuser, the image forming apparatus may use a phase control method by detecting a zero-cross point of input power. In other words, the image forming apparatus may control electric power for heating the fuser through phase control to accurately control the temperature of the fuser.

SUMMARY

One or more example embodiments include a method and apparatus for attenuating a harmonic high-frequency signal generated during phase control.

One or more example embodiments include a computer readable recording medium having recorded thereon a program for executing the above method.

Additional aspects will be set forth in the description which follows and will be apparent from the description, or may be learned by practice of the presented embodiments.

According to one or more example embodiments, an image forming apparatus for controlling input power applied to a heating body through phase control includes a fuser having the heating body, a switching unit supplying the input power to the heating body, and a phase controller determining an input phase of the input power according to a temperature of the fuser, wherein the phase controller further controls the switching unit to vary a phase of the input power supplied to the heating body within a phase range set based on the input phase, for each control cycle of the input power.

According to one or more example embodiments, a phase control method includes receiving a temperature of a fuser, determining an input phase of an input power according to the temperature of the fuser, and varying a phase of the input power supplied to the heating body within a phase range set based on the input phase, for each control cycle of the input power.

BRIEF DESCRIPTION OF THE DRAWINGS

These and other aspects will become apparent and more readily appreciated from the following description of the embodiments, taken in conjunction with the accompanying drawings in which.

DETAILED DESCRIPTION

Figure 1:
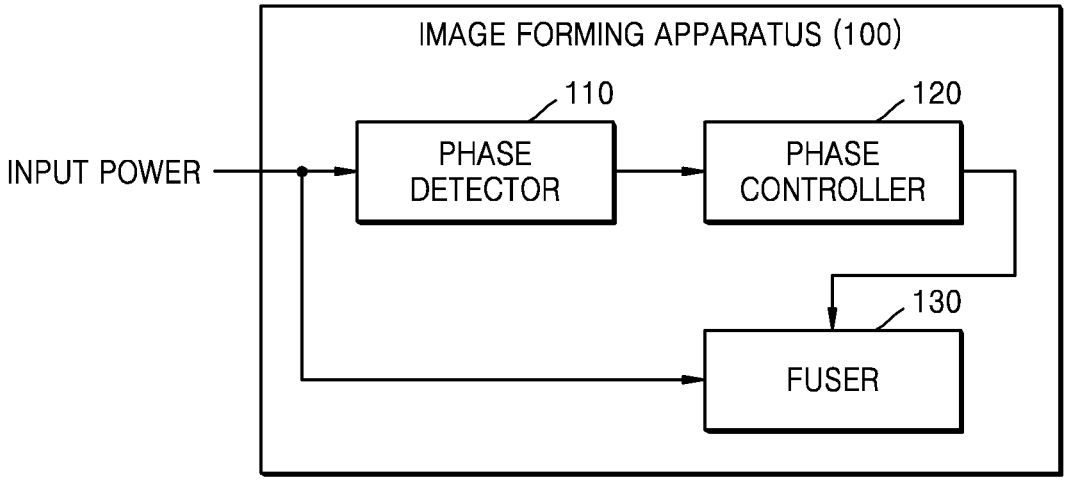
FIG. 1 is a block diagram of an image forming apparatus according to an example embodiment.

The example embodiments are described in detail with reference to the accompanying drawings. However, the embodiments are not limited thereto and it will be understood that various changes in form and details may be made therein without departing from the spirit and scope of the following claims. That is, descriptions on particular structures or functions may be presented merely for explaining example embodiments.

Terms such as "first" and "second" are used herein merely to describe a variety of constituent elements, but the constituent elements are not limited by the terms. Such terms are used only for the purpose of distinguishing one constituent element from another constituent element. For example, without departing from the scope of the example embodiments described herein, a first constituent element may be referred to as a second constituent element, and vice versa.

Terms used in the present specification are used for explaining a specific example embodiment, not for limiting the example embodiments. Thus, an expression used in a singular form in the present specification also includes the expression in its plural form unless clearly specified otherwise in context. Also, terms such as "include" or "comprise" may be construed to denote a certain characteristic, number, step, operation, constituent element, or a combination thereof, but may not be construed to exclude the existence of or a possibility of addition of one or more other characteristics, numbers, steps, operations, constituent elements, or combinations thereof.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

FIG. 1 is a block diagram of an image forming apparatus 100 according to an example embodiment. Referring to FIG. 1, the image forming apparatus 100 may include a phase detector 110, a phase controller 120, and a fuser 130.

The image forming apparatus 100 may control a temperature of the fuser 130 by detecting a phase of input power. In detail, the image forming apparatus 100 may control electric power supplied to the fuser 130 by using a phase control method.

The image forming apparatus 100 may be, for example, and without limitation, a printer, a facsimile, a multifunction printer, etc. In addition, the image forming apparatus 100 may output an image by using laser.

The input power may be an alternating current signal of 110 V or 220 V supplied to the image forming apparatus 100. "110 V" or "220 V" may denote an amount of a voltage generally supplied to the image forming apparatus 100. Input power having a different amount of a voltage may be supplied to the image forming apparatus 100.

The phase detector 110 detects a phase of the input power. In detail, the phase detector 110 detects a zero-cross point of the input power. The zero-cross point is where the magnitude of the input power is zero. When detecting the zero-cross point, the phase detector 110 generates a digital zero-cross signal and outputs the generated digital zero-cross signal to the phase controller 120. For example, the digital zero-cross signal may have a rectangular pulse shape.

The phase controller 120 detects a reference phase of the input power through the digital zero-cross signal. Since a point where the digital zero-cross signal is detected is a zero-cross point at which the magnitude of the input power is zero, the phase controller 120 may calculate a phase of the input power based on the zero-cross point. The input phase may be a time point when the input power is supplied to a heating body. In other words, the phase controller 120 may start to supply the input power to the heating body at an input phase of the input power.

The fuser 130 may include a heating body. The heating body generates heat according to the electric power that is supplied. The heating body may be a lamp that generates heat when receiving input power. The heating body may include at least one lamp, which may be referred to as a center lamp, a side lamp, etc. according to the position of a lamp.

The phase controller 120 may control the electric power supplied to the heating body by turning on/off a switch connected to the heating body. The phase controller 120 monitors a change in the phase of the input power. When the input power is at a desired phase, the phase controller 120 controls the switch to be in an "ON" state, thereby controlling a time point when the input power is supplied to the heating body.

The phase controller 120 may heat the fuser 130 by controlling the electric power supplied to the fuser 130 through phase control. The phase controller 120 may perform the phase control based on the phase of input power. In other words, the phase controller 120 determines the electric power to be supplied to the heating body and calculates a start phase and an end phase of the input power in order to supply the determined electric power. In other words, the phase controller 120 may control a time point to apply the input power so that only a part of a waveform of the input power is supplied to the heating body.

When the phase controller 120 supplies electric power to the heating body through the phase control, a harmonic high-frequency signal is generated. Unlike waveform number control, since a part of waveform is controlled to be applied to the heating body in the phase control, high frequency signals are generated. Accordingly, to attenuate the harmonic high-frequency signal, the phase controller 120 may perform phase control by delaying an input phase by a predetermined deviation for each waveform. In other words, the phase controller 120 may change the input phase to a lagging phase or a leading phase within a set range and may perform the phase control according to a changed input phase.

The phase controller 120 may perform the phase control by delaying an input phase by a predetermined deviation for each waveform. The phase controller 120 may change the input phase for each of waveforms or control cycles of the input power. The phase controller 120 may change the input phase within a phase range set based on the input phase. For example, when the input phase is 30°, the phase controller 120 may change the input phase within a range between 28° to 32°. The first waveform may be applied to a heating body 132 (see FIG. 2) from 30°. The second waveform may be applied to the heating body 132 from 31°. The third waveform may be applied to the heating body 132 from 29°.

The control cycle may be a cycle at which the phase controller 120 corrects an input phase of the input power. The control cycle may be determined according to the shape of a waveform of the input power supplied by the phase controller 120 to the fuser 130. For example, the control cycle may be a half wave or one wave of the input power. When the control cycle is a half wave, the input phase may be between 0° to 180°. When the control cycle is one wave, the input phase may be between 0° to 360°.

When the temperature of the heating body is controlled using the phase control method, ripple heat may be reduced. Ripple heat denotes a phenomenon that the temperature of the fuser 130 is higher or lower than a set temperature. Since in a waveform number control method the input power supplied to the heating body may not be precisely controlled, the ripple heat grows to be greater than that of the phase control method. However, when the phase control method is used, a harmonic high-frequency signal is generated. In particular, when both a center lamp and a side lamp are controlled using the phase control method, the generation of a harmonic high-frequency signal may be increased. Accordingly, in order to spread the harmonic high-frequency signal, the phase controller 120 may maintain the input phase constant or may control the input phases of the center lamp and the side lamp to be different from each other.

The phase control method to attenuate a harmonic high-frequency signal is described below in detail with reference to FIG. 2.

Figure 2:
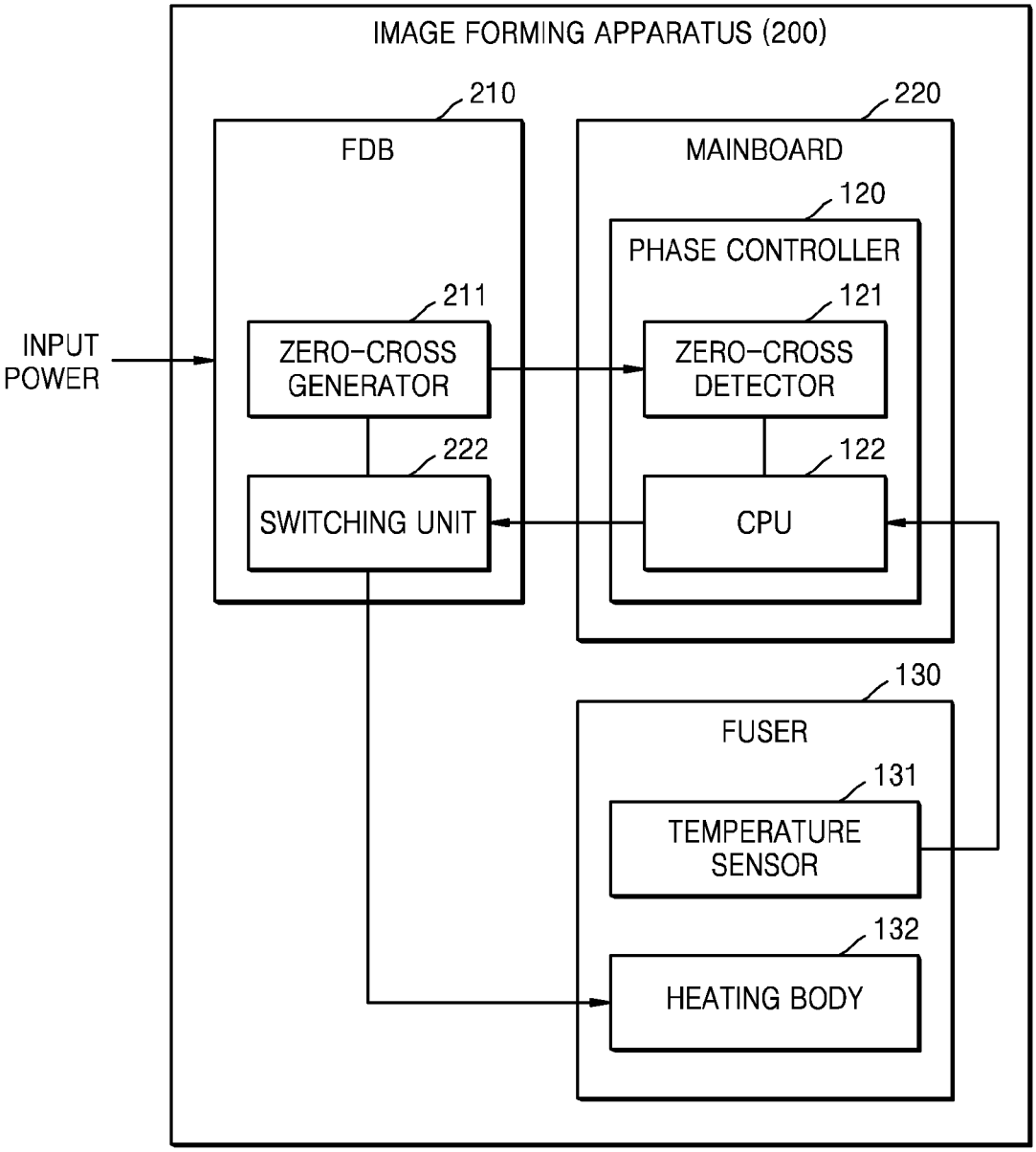
FIG. 2 is a block diagram of an image forming apparatus according to another example embodiment.

FIG. 2 is a block diagram of an image forming apparatus 200 according to another example embodiment. Referring to FIG. 2, the image forming apparatus 200 may include a fuser driver board (FDB) 210, a mainboard 220, and a fuser 130.

The FDB 210 may include a zero-cross generator 211 and a switching unit 222.

The zero-cross generator 211 receives input power. For example, the input power may be an alternating current.

The zero-cross generator 211 generates an analog zero-cross signal at a zero-cross point of the input power. The zero-cross generator 211 outputs the analog zero-cross signal to the zero-cross detector 121 of the mainboard 220. The analog zero-cross signal may be a triangular pulse and is generated at a time point when the magnitude of the input power is 0.

The switching unit 222 supplies the input power to the heating body 132. In other words, the switching unit 222 connects the input power and the heating body 132. The switching unit 222 is controlled by a central processing unit (CPU) 122. The switching unit 222 is turned on/off according to a signal received from the CPU 122. The CPU 122 may determine on/off timing of the switching unit 222 by calculating a phase of the input power. Controlling of turning a switch on/off by the CPU 122 is referred to as the phase control.

The switching unit 222 may include one or more switches. For example, when the heating body 132 includes two lamps, the switching unit 222 may include two switches connected to the lamps.

The mainboard 220 may include the phase controller 120 and the phase controller 120 may include the zero-cross detector 121 and the CPU 122.

The zero-cross detector 121 converts the analog zero-cross signal to a digital zero-cross signal, and outputs the digital zero-cross signal to the CPU 122.

The CPU 122 detects a phase of the input power through the digital zero-cross signal. The CPU 122 may determine a moment when the digital zero-cross signal is detected, as a time point when the magnitude of the input power is zero. Accordingly, the CPU 122 may calculate a phase of input power based on the digital zero-cross signal. The CPU 122 may determine an input phase of the input power applied to the fuser 130 for each control cycle of the input power and may precisely control the temperature of the fuser 130.

The CPU 122 may determine an input phase of the input power according to the temperature of the fuser 130, and may control the switching unit 222 such that a phase of the input power applied to the heating body 132 varies within a range set based on the input phase for each control cycle of the input power. The CPU 122 may randomly determine the phase for each control cycle within the set phase range, thereby controlling the switching unit 222. Also, the CPU 122 may determine the input phase to gradually lag or lead within a set range. In other words, the CPU 122 may change the input phase so as to sequentially lag or lead by a predetermined phase with respect to the input phase for each control cycle, and may control the switching unit 222 according to a changed input phase.

When a frequency of the input power is 50 Hz, the set phase range may be from a phase lagging the input phase by 18° to a phase leading the input phase by 18°, or from a phase lagging the input phase by 10% to a phase leading the input phase by 10%. For example, when an input phase is 90°, a set phase range may be 72° to 108° or 81° to 99°. Also, a switching time may have a deviation between −1 ms to +1 ms from a reference time when the input power is applied according to the input phase.

When a frequency of the input power is 60 Hz, the switching time may have a deviation between −1 ms to +1 ms from a time according to the input phase.

Since the precise control of the temperature of the heating body 132 is difficult as a difference between the reference phase and the input phase increases, the switching time may be limited to the above range.

The CPU 122 receives the temperature of the fuser 130 from a temperature sensor 131, and determines the input phase based on the temperature of the fuser 130 and a deviation between the temperature of the fuser 130 and a target temperature. The fuser 130 may further include the temperature sensor 131 for measuring the temperature of the fuser 130. The CPU 122 may receive in real time the temperature of the fuser 130 from the temperature sensor 131. The CPU 122 sets the target temperature of the fuser 130 and calculates a difference between the target temperature and a current temperature of the fuser 130. The CPU 122 determines the electric power to be supplied to the heating body 132 based on a calculated temperature difference. The CPU 122 determines an input phase of the determined electric power supplied to the heating body 132, and controls on/off timing of the switch included in the switching unit 222 by referring to the zero-cross point.

The heating body 132 may include one or more lamps. For example, the heating body 132 may include a center lamp (not shown) and a side lamp (not shown). The switching unit 222 may include as many switches as the number of lamps. For example, the switching unit 222 may include a first switch connected to the center lamp and a second switch connected to the side lamp.

The zero-cross detector 121 transforms the analog zero-cross signal to a digital zero-cross signal, and detects a phase of the input power through the digital zero-cross signal. When the zero-cross signal has a triangular pulse shape, the zero-cross detector 121 may generate digital zero-cross signal by clipping a triangular pulse at a predetermined position.

Figure 3:
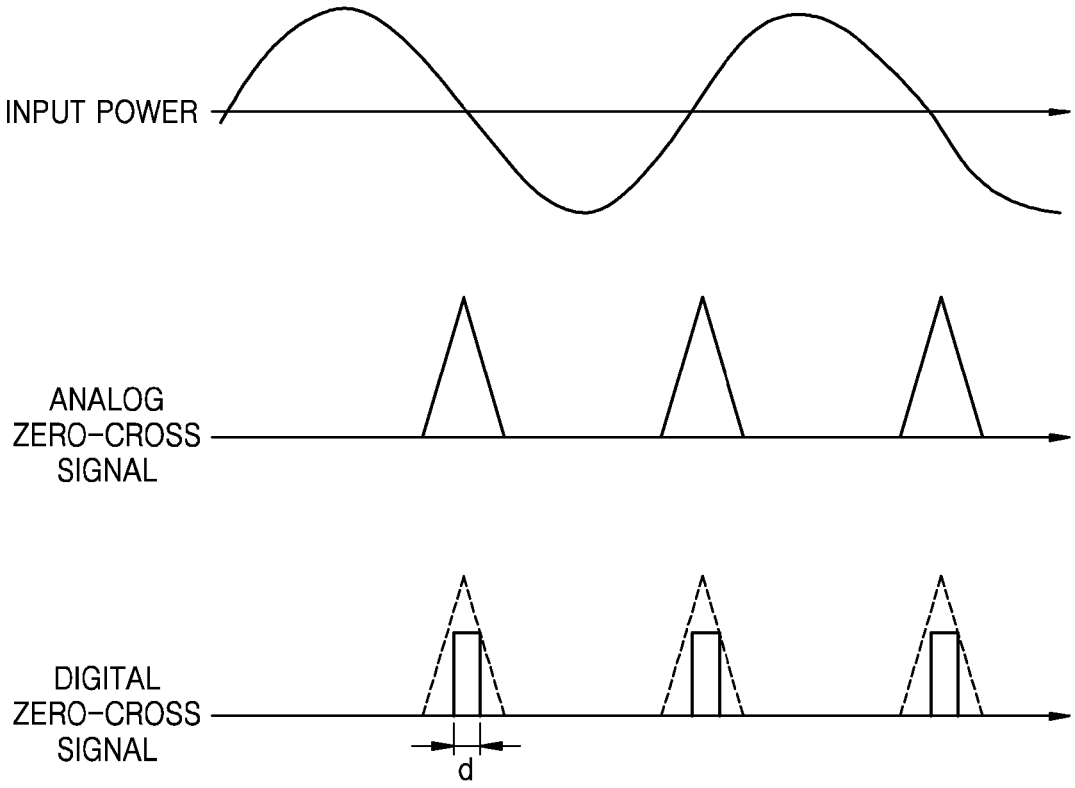
FIG. 3 illustrates waveforms of an analog zero-cross signal and a digital zero-cross signal.

FIG. 3 illustrates waveforms of an analog zero-cross signal and a digital zero-cross signal. The input power is an alternating signal input to the image forming apparatus 100 or 200.

The analog zero-cross signal is a signal generated at a position where the input power meets a horizontal axis. For example, as illustrated in FIG. 3, the zero-cross signal may have a triangular pulse shape.

The digital zero-cross signal may be generated by clipping the analog zero-cross signal. For example, the digital zero-cross signal may be a signal having a rectangular pulse shape. Accordingly, the digital zero-cross signal may be recognized by the CPU 122 as a digital signal. In other words, the CPU 122 may determine a moment when the digital zero-cross signal is detected, as a zero-cross point.

Figure 4:
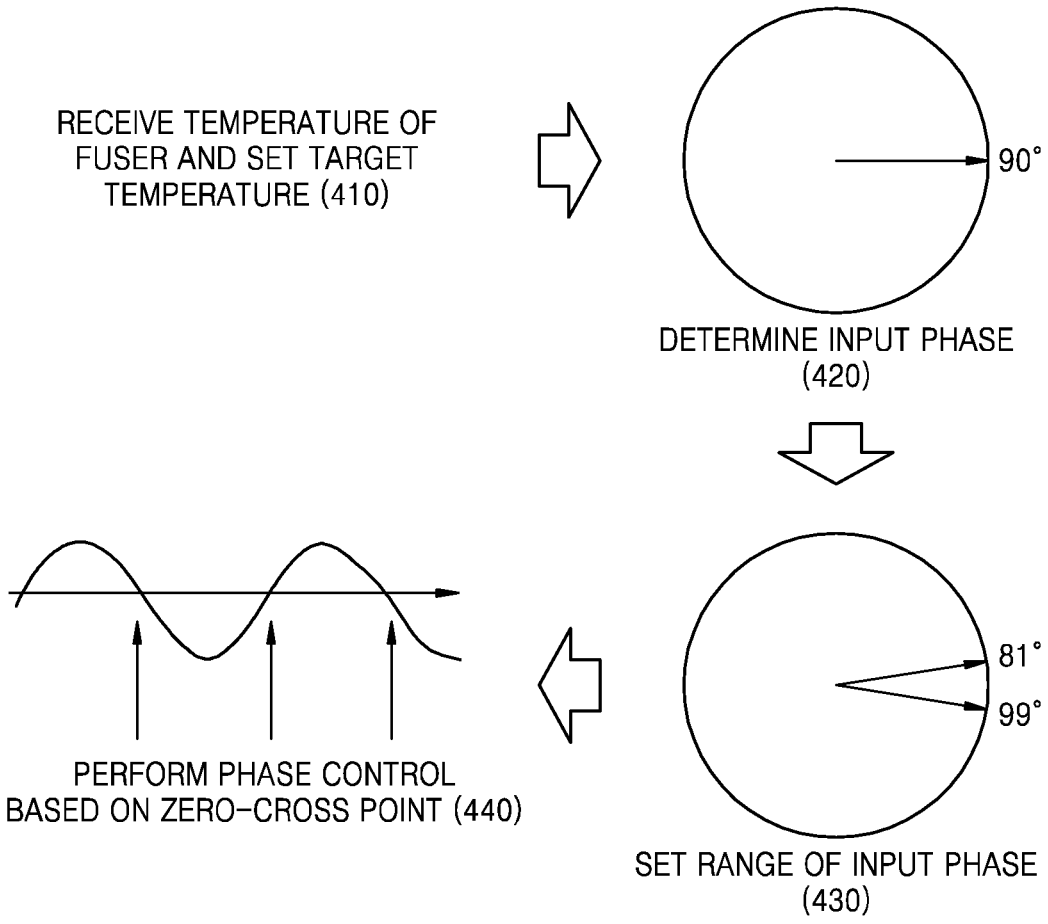
FIG. 4 illustrates a phase control method according to an example embodiment.

FIG. 4 illustrates a phase control method according to an example embodiment.

In Operation 410, the phase controller 120 receives the temperature of the fuser 130, and sets the target temperature based on the temperature of the fuser 130.

In Operation 420, the phase controller 120 determines the input phase based on the temperature of the fuser 130 and the target temperature. For example, the phase controller 120 may determine the input phase as 90°.

In Operation 430, the phase controller 120 sets a range of the input phase. The phase controller 120 sets the range that may reduce an influence on a change in the temperature of the heating body 132. For example, the phase controller 120 may set a range from a phase lagging the determined input phase by 10% or a phase leading the input phase by 10%. Accordingly, the range of the input phase may be set from 81° to 99°.

In Operation 440, the phase controller 120 performs phase control based on the zero-cross point. The phase controller 120 controls a supply time of the input power within the phase range set based on the zero-cross point.

Figure 5:
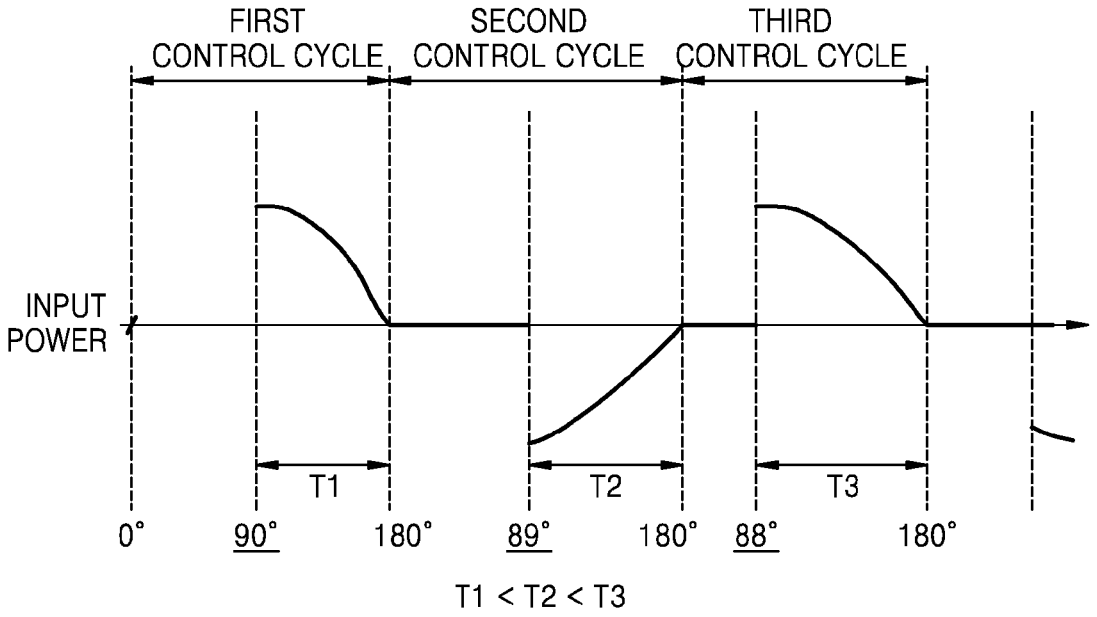
FIG. 5 is a graph of an example of a phase control method.

FIG. 5 is a graph illustrating an example of a phase control method. Referring to FIG. 5, it may be seen that the input phase gradually decreases within a set range.

The input phase at the first control cycle is 90°, the input phase at the second control cycle is 89°, and the input phase at the third control cycle is 88°. Since the input phase gradually decreases, time periods T1, T2, and T3 for applying the input power to the heating body 132 gradually increase.

The first control cycle denotes the first half wave of the input power, the second control cycle denotes the second half wave of the input power, and the third control cycle denotes the third half wave of the input power.

Figure 6:
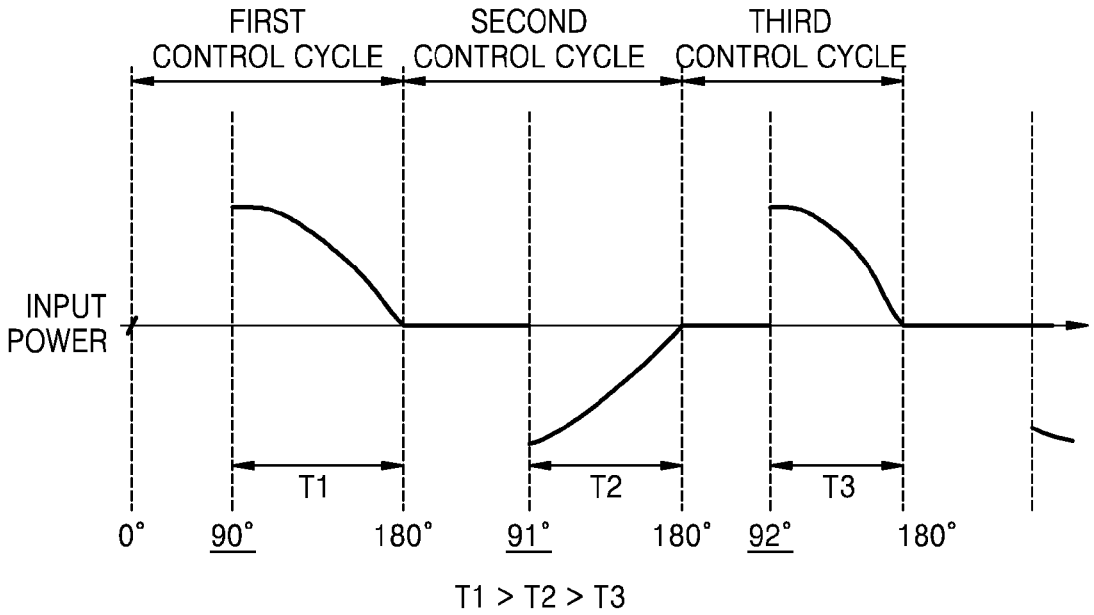
FIG. 6 is a graph of another example of a phase control method.

FIG. 6 is a graph illustrating another example of a phase control method. Referring to FIG. 6, it may be seen that the input phase gradually leads within a set range.

The input phase at the first control cycle is 90°, the input phase at the second control cycle is 91°, and the input phase at the third control cycle is 92°. Since the input phase gradually increases, time periods T1, T2, and T3 for applying the input power to the heating body 132 gradually increases.

Figure 7:
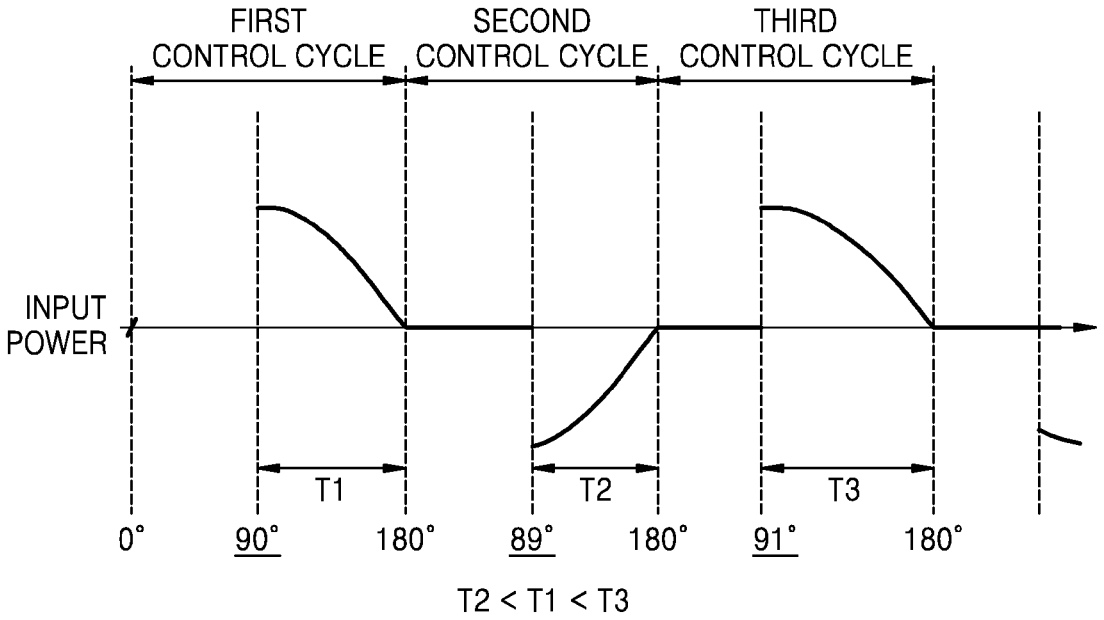
FIG. 7 is a graph of another example of a phase control method.

FIG. 7 is a graph illustrating another example of a phase control method. Referring to FIG. 7, a pattern in which the input phase varies within a set range is illustrated.

The input phase at the first control cycle is 90°, the input phase at the second control cycle is 89°, and the input phase at the third control cycle is 91°. The input phase may lead or lag with respect to the originally determined input phase.

Figure 8:
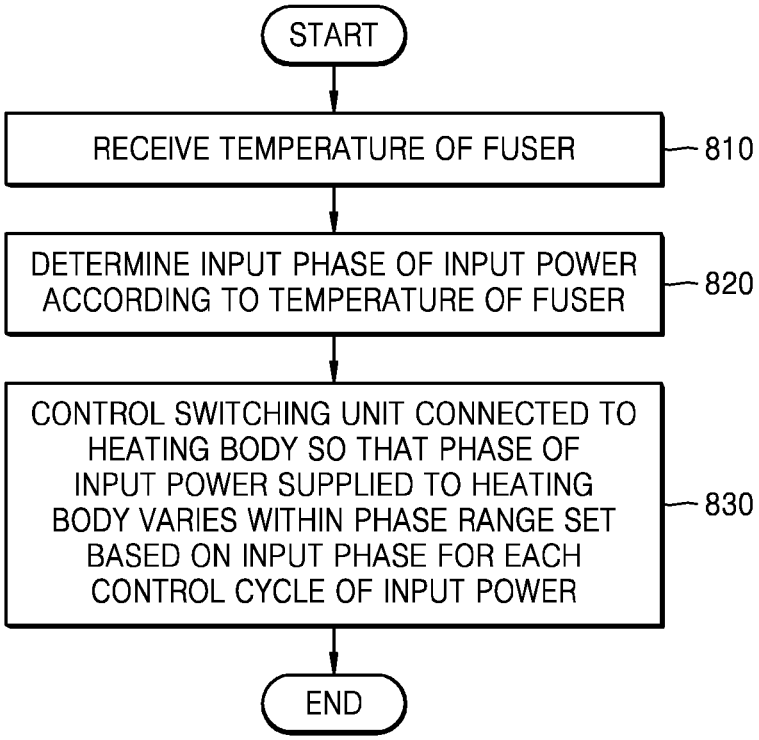
FIG. 8 is a flowchart of a phase control method according to an example embodiment.

FIG. 8 is a flowchart illustrating a phase control method according to an example embodiment. The phase control method of FIG. 8 is performed by the image forming apparatus 100 of FIG. 1 or the image forming apparatus 200 of FIG. 2. Accordingly, the descriptions about the image forming apparatus 100 or 200, though omitted below, are identically applied to the phase control method of FIG. 8.

In Operation 810, the phase controller 120 receives the temperature of the fuser 130. The temperature of the fuser 130 varies during a fusing process. Accordingly, the phase controller 120 may receive and monitor in real time the temperature of the fuser 130.

In Operation 820, the phase controller 120 determines an input phase of the input power according to the temperature of the fuser 130. When the temperature of the fuser 130 rises or falls, the phase controller 120 adjusts the electric power supplied to the heating body 132 to maintain the temperature of the fuser 130 at the target temperature. Accordingly, the phase controller 120 determines when to start to supply the input power to the heating body 132 according to the temperature of the fuser 130.

In Operation 830, the phase controller 120 controls the switching unit 222 connected to the heating body 132 so that a phase of the input power supplied to the heating body 132 varies within a set phase range based on the input phase for each control cycle of the input power. The phase controller 120 may prevent accumulation of harmonic high-frequency signals by controlling the input phase to be different for each control cycle.

The apparatus described herein may comprise a processor, a memory for storing program data to be executed by the processor, a permanent storage such as a disk drive, a communications port for handling communications with external devices, and user interface devices, including a display, keys, etc. When software modules are involved, these software modules may be stored as program instructions or computer readable code executable by the processor on a non-transitory computer-readable media such as read-only memory (ROM), random-access memory (RAM), CD-ROMs, magnetic tapes, floppy disks, and optical data storage devices. The computer readable recording media may also be distributed over network coupled computer systems so that the computer readable code is stored and executed in a distributed fashion. This media can be read by the computer, stored in the memory, and executed by the processor.

The example embodiments may be described in terms of functional block components and various processing steps. Such functional blocks may be realized by any number of hardware and/or software components configured to perform the specified functions. For example, the example embodiment may employ various integrated circuit components, e.g., memory elements, processing elements, logic elements, look-up tables, and the like, which may carry out a variety of functions under the control of one or more microprocessors or other control devices. Similarly, where the elements of the example embodiments are implemented using software programming or software elements, the example embodiments may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the example embodiments may employ any number of conventional techniques for electronics configuration, signal processing and/or control, data processing and the like. The words "mechanism" and "element" are used broadly and are not limited to mechanical or physical embodiments, but may include software routines in conjunction with processors, etc.

The particular implementations shown and described herein are illustrative examples of the example embodiments and are not intended to otherwise limit the scope of the example embodiments in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device.

The use of terms "a" and "an" and "the" and similar referents in the context of describing the example embodiments (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context. The use of any and all examples, or exemplary language (e.g., "such as") provided herein, is intended merely to better illuminate the example embodiments and does not pose a limitation on the scope of the example embodiments unless otherwise claimed. Numerous modifications and adaptations will be readily apparent to those of ordinary skill in this art without departing from the spirit and scope of the inventive concept.

As described above, according to the one or more of the above example embodiments, the image forming apparatus according to an example embodiment may prevent accumulation of harmonic high-frequency signals by giving a deviation to the time when the input power is supplied to the heating body for each control cycle.

In the image forming apparatus according to an example embodiment, ripple heat may be reduced by precisely controlling the temperature of the heating body through the phase control.

In the image forming apparatus according to an example embodiment, electric power may be supplied to the center lamp and the side lamp through the phase control.

It should be understood that the example embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the true spirit and full scope of the embodiments as defined by the following claims.

What is claimed is:

1. An image forming apparatus, comprising:

a fuser comprising a heating body;

a switching unit configured to supply input power to the heating body; and a phase controller configured:

to determine a first input phase of the input power for a first control cycle based on a temperature of the fuser, to set a phase range, based on the first input phase, for a plurality of consecutive control cycles subsequent to the first control cycle, and to control the switching unit so that a phase of the input power supplied to the heating body is varied within the phase range set for each of the plurality of consecutive control cycles subsequent to the first control cycle, by controlling respective input phases for each of the plurality of consecutive control cycles to lag or lead the first input phase by a respective predetermined amount in a sequential manner.

2. The apparatus of claim 1, wherein the phase range is from a phase lagging the first input phase by 18° to a phase leading the first input phase by 18°.

3. The apparatus of claim 1, wherein the fuser further comprises a temperature sensor configured to measure a temperature of the fuser, wherein the phase controller is configured to receive the temperature of the fuser from the temperature sensor and determine the first input phase based on a deviation between the temperature of the fuser and a target temperature.

4. The apparatus of claim 1, wherein the heating body comprises a center lamp and a side lamp, and the phase controller is configured to control the phase of input power applied to the center lamp and the side lamp.

5. The apparatus of claim 4, wherein the switching unit comprises a first switch connected to the center lamp and a second switch connected to the side lamp, wherein the phase controller is configured to control the switching unit and is further configured to turn on the first switch and to turn on the second switch at different time points.

6. The apparatus of claim 1, wherein the phase controller is configured to change a supply time of the input power within a range of −1 ms to +1 ms for each control cycle.

7. The apparatus of claim 1, wherein the phase controller is configured to control a second input phase for a second control cycle immediately following the first control cycle to lag or lead the first input phase by a first predetermined amount, the phase controller is configured to control a third input phase for a third control cycle immediately following the second control cycle to lag or lead the first input phase by a second predetermined amount, and the first input phase, second input phase, and third input phase are sequential.

8. The apparatus of claim 7, wherein an absolute difference between the second input phase and the first input phase is equal to an absolute difference between the third input phase and the first input phase.

9. The apparatus of claim 1, wherein the phase controller is configured to control the respective input phases for the plurality of consecutive control cycles to be increased by a uniform amount for each consecutive control cycle, such that an absolute difference between any two input phases for two consecutive control cycles among the plurality of consecutive control cycles is equal to an absolute difference between any other two input phases for another two consecutive control cycles among the plurality of consecutive control cycles, the absolute differences being greater than zero.

10. The apparatus of claim 1, wherein the first control cycle and the plurality of consecutive control cycles correspond to a half wave of the input power, and the first input phase of the input power has a value between 0° and 180°.

11. The apparatus of claim 1, wherein the first control cycle and the plurality of consecutive control cycles correspond to one wave of the input power, and the first input phase of the input power has a value between 0° and 360°.

12. A phase control method, comprising:

receiving a temperature of a fuser;

determining a first input phase of an input power for a first control cycle based on the temperature of the fuser;

setting a phase range, based on the first input phase, for a plurality of consecutive control cycles subsequent to the first control cycle;

varying, for the plurality of consecutive control cycles subsequent to the first control cycle, a phase of the input power supplied to a heating body of the fuser within the phase range set based on the input phase, wherein the varying comprises:

controlling, via a switching unit, respective input phases for each of the plurality of consecutive control cycles to lag or lead the first input phase by a respective predetermined amount in a sequential manner.

13. The method of claim 12, wherein the phase range is from a phase lagging the first input phase by 18° to a phase leading the first input phase by 18°.

14. The method of claim 12, wherein determining the first input phase comprises determining the input phase based on a deviation between the temperature of the fuser and a target temperature.

15. The method of claim 12, wherein the varying further comprises controlling a phase of input power applied to a center lamp and a side lamp included in the heating body.

16. The method of claim 15, wherein the varying further comprises controlling turn-on time points of a first switch connected to the center lamp and controlling turn-on time points of a second switch connected to the side lamp wherein the turn-on time points are different from each other.

17. The method of claim 12, further comprising changing a supply time of the input power within a range of −1 ms to +1 ms for each control cycle.

18. A non-transitory computer readable storage medium having stored thereon a program, which when executed by a computer, performs the method of claim 12.

* * * * *